US005339872A

United States Patent [19]

Marino

[11] Patent Number: 5,339,872

[45] Date of Patent: Aug. 23, 1994

[54] SPILL CONTAINMENT BAG

[76] Inventor: Thomas F. Marino, 26 Hydelor Ave., Prospect, Conn. 06712

[21] Appl. No.: 132,463

[22] Filed: Oct. 6, 1993

[51] Int. Cl.[5] ..... B67D 5/00

[52] U.S. Cl. ..... 141/001; 141/10; 141/86; 141/88; 141/311 A; 141/331; 141/340; 141/397; 137/312; 222/108; 248/99; 383/407

[58] Field of Search ..... 141/1, 10, 86, 87, 88, 141/98, 117, 311 A, 340, 331, 337; 137/312; 220/573, 571; 222/108; 248/99; 383/907, 104, 36

[56] References Cited

U.S. PATENT DOCUMENTS

| | | | |
|---|---|---|---|
| 446,518 | 2/1891 | Hesser . | |
| 702,181 | 6/1902 | Boyd | 137/313 X |
| 1,190,713 | 7/1916 | Bokop | 141/337 X |
| 2,754,869 | 6/1954 | Bartels . | |
| 3,727,656 | 4/1973 | Luders . | |
| 4,020,922 | 5/1977 | Klasel . | |
| 4,211,266 | 7/1980 | Massey . | |
| 4,240,474 | 12/1980 | Perkins . | |
| 4,245,666 | 1/1981 | Norris | 141/337 X |
| 4,307,764 | 12/1981 | Nattrass . | |
| 4,550,755 | 11/1985 | Vredenburg, Sr. . | |
| 4,592,448 | 6/1986 | Morris | 184/1.5 |
| 4,633,899 | 1/1987 | Lord | 137/312 |
| 4,676,284 | 6/1987 | DeCrane . | |
| 4,991,633 | 2/1991 | Wong . | |
| 5,099,872 | 3/1992 | Tarvin et al. | 141/114 X |
| 5,238,033 | 8/1993 | Bald | 141/86 |

*Primary Examiner*—Ernest G. Cusick

[57] ABSTRACT

A spill containment bag for use with a container having a leak includes a flexible bag member defining an enclosure and having a lower section with a bottom wall and a sidewall extending upwardly and inwardly from the periphery of the bottom wall to a reduced cross section at its upper end intermediate the height of the bag member. The bag member also has an upper section with a sidewall extending upwardly therefrom, and the sidewall of the upper section has at least its upper portion extending outwardly to provide an opening of enlarged cross section at the upper end of the bag member. At least one strap is provided to secure the bag member to a leaking container so as to position the opening at the upper end thereof beneath the point of leakage.

13 Claims, 5 Drawing Sheets

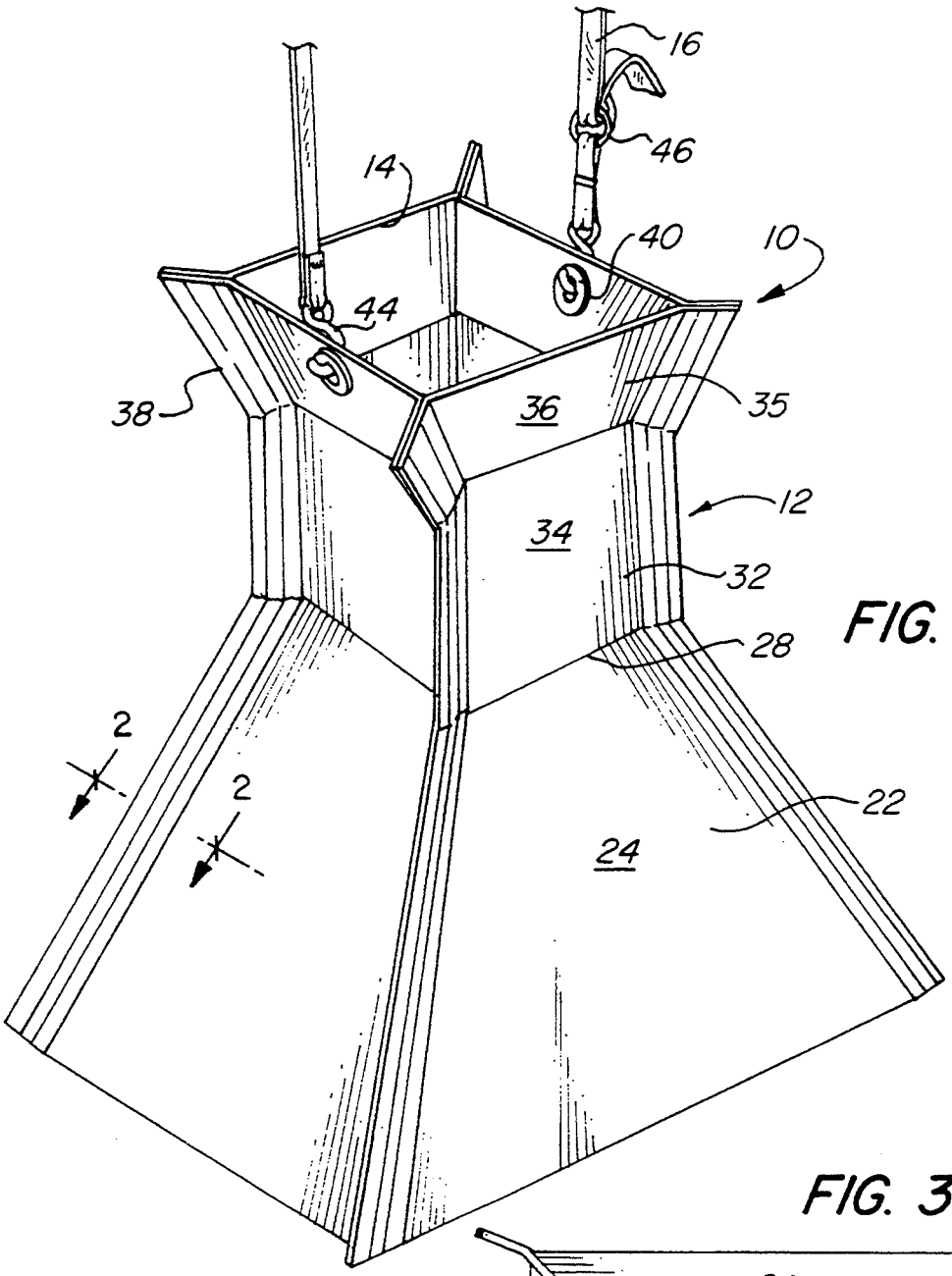
FIG. 1
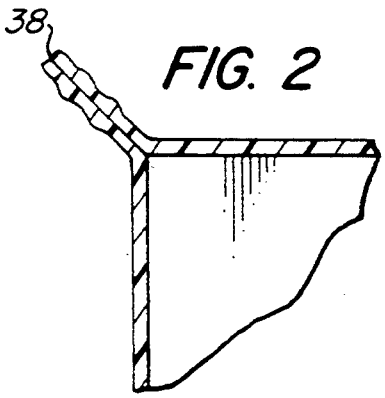
FIG. 2
FIG. 3
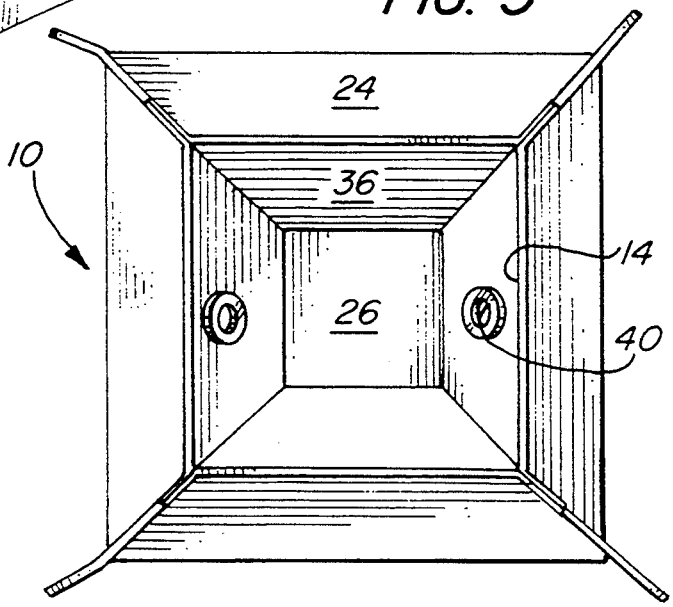

SPILL CONTAINMENT BAG

BACKGROUND OF THE INVENTION

The present invention relates generally to receptacles for receiving spills of liquid or solid material, and, more particularly, to a collapsible spill containment bag for use with a leaking container.

The transportation of hazardous and non-hazardous liquid and solid chemical and petroleum products is a thriving industry in this and other countries, with large quantities of such products being transported annually. Tanker trucks and railroad tanker cars having storage tanks are normally utilized to effect the transport of these materials and will sometimes develop leaks in their valves or tank walls, thereby permitting the contents to spill into the outside environment. Such leaks are not infrequent and can occur from undetected damage, aging of the equipment, or continual vibration.

Within factories, these materials are often stored in tanks or other containers of varying designs and sizes. Often, a complex array of conduits and valves will be used to transport and combine the materials in the tanks. These, as well as the conduits and valves, represent potential points of leakage as a result of corrosion, impacts and other failure of materials.

The resulting spills not only result in the commercial loss of product, but also they often jeopardize the environment and may even pose a direct and immediate hazard to human health and safety in the case of hazardous substances. Accordingly, some statutes have been enacted which impose fines upon the operators of tank transports if a spill occurs. The operators are generally required to absorb the cost of the cleanup of the spill.

The term "container" as used herein refers to stationary and transportable storage tanks and other storage vessels such as bins, hoppers and the like.

It is an object of the present invention to provide a novel spill containment bag for use with a leaking container for placement adjacent the point of leakage therefrom.

It is also an object to provide such a containment bag which is collapsible for convenient transport or storage, thereby enabling rapid deployment in the development of a leak.

A further object is to provide such a bag which may be readily and relatively economically fabricated.

SUMMARY OF THE INVENTION

It has now been found that the foregoing and related objects may be readily attained in a spill containment bag for use with a container having a leak. The bag includes a flexible bag member defining an enclosure and has a lower section with a bottom wall and a sidewall extending upwardly and inwardly from the periphery of the bottom wall to a reduced cross section at its upper end intermediate the height of the bag member. The bag member also has an upper section with a sidewall extending upwardly from the lower section and the sidewall of the upper section has at least its upper portion extending outwardly to provide an opening of enlarged cross section at the upper end of the bag member. The bag also includes means for securing the bag member to a leaking container so as to position the opening at the upper end thereof directly beneath a point of leakage.

In one embodiment, the bag has a circular cross section providing a frustroconical lower section and a shorter, inverted frustroconical upper section, In another embodiment, the flexible bag member has a rectangular cross section with the bottom wall being rectangular in shape, and the sidewall of the lower section and the upper portion of the sidewall of the upper section having panels which are generally trapezoidal in configuration. Desirably, the sidewall of the upper section has a generally rectangular lower portion providing a collar above the sidewall of the lower section.

The securing means includes at least one pair of straps engaged with the bag and extending thereabove. The straps may extend about the bottom wall and along the sidewalls of said upper and lower sections and may include means for adjusting the length thereof.

In one embodiment, the enclosure is fabricated from a liquid impervious material for use with a liquid leak. In some embodiments, there are included a collar in the bag member at the juncture of the upper and lower sections and a closure engageable in the collar to seal the closure.

In containing a spill from a container having a leak, the securing means of the spill containment bag is engaged with a portion of a leaking container. The containment bag is oriented so that the opening in the bag is disposed below and adjacent the point of the leak, and the spill from the point of the leak from the container is allowed to flow through the opening and to collect in the enclosure.

BRIEF DESCRIPTION OF THE DRAWINGS

FIG. 1 is a perspective view of a spill containment bag shown in extended position and with its strap fragmentarily illustrated;

FIG. 2 is a fragmentary enlarged sectional view of the spill containment bag of FIG. 1 taken along the line 2—2 to show the detail of one of the seams;

FIG. 3 is a top plan view of the spill containment bag of FIG. 1;

DETAILED DESCRIPTION OF THE PREFERRED EMBODIMENT

Figure 4:
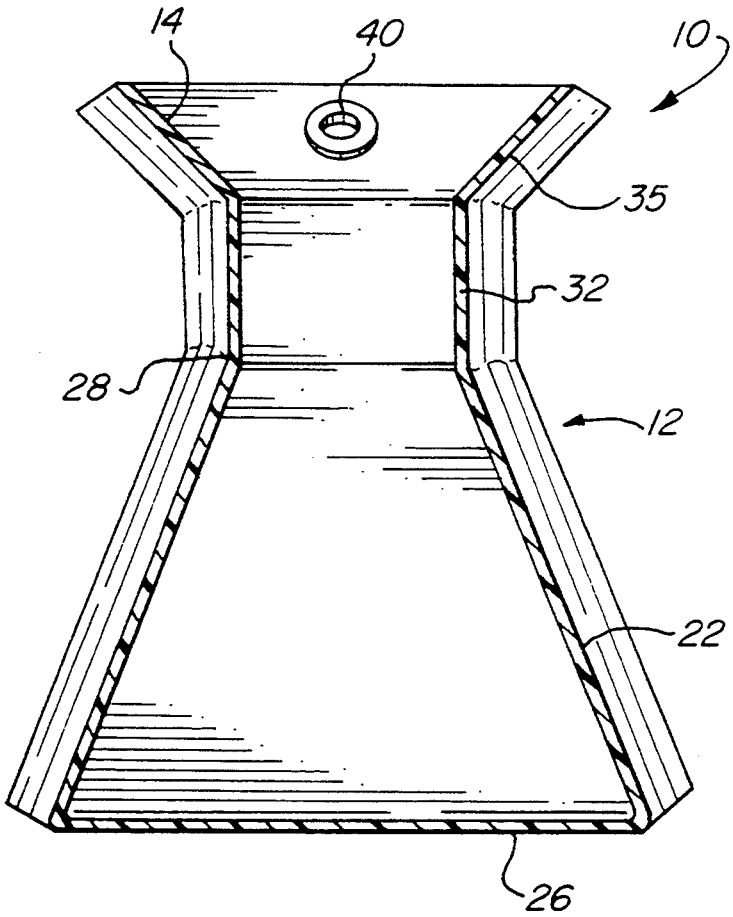
FIG. 4 is a cross sectional view of the spill containment bag taken along the line 4—4 of FIG. 1.

Turning first in detail to FIG. 1, therein illustrated is a spill containment bag embodying the present invention and generally designated by the numeral 10. The containment bag 10 includes a flexible bag member generally designated by the numeral 12 and having an opening 14 at its upper end, and a securing strap generally designated by the numeral 16.

The bag member 12 includes a lower section defined by the lower sidewall 22 comprised of four lower panels 24, all of trapezoidal configuration. The panels 24 of the lower sidewall 22 extend upwardly and inwardly from the periphery of a rectangular bottom wall 26 to a reduced cross section at the upper end 28 of the lower section, in order to provide increased stability. In one illustrated embodiment, a collar 32 extends vertically upwardly from the upper end 28 of the lower sidewall 22, and it is comprised of four collar panels 34, all of rectangular configuration. A funnel shaped upper section 35 extends upwardly and outwardly from the upper margin of the collar 32 to provide the opening 14 at its upper edge. The upper section 35 has four funnel panels 36, all of trapezoidal configuration.

At least one pair of opposing strap eyelets 40 is provided adjacent the upper edge of opposing panels 36 of the upper section. Alternatively, the eyelets 40 may be placed in the seams 38 between adjacent funnel panels 36 and adjacent the opening 14. A strap 16 is provided for each pair of opposing strap eyelets 40, and these include hooks 44 at each end thereof to engage in the strap eyelets 40, and a length adjustment buckle 46 to adapt the strap 16 to different installation situations. Preferably, the straps 16 are made from a high strength nylon web material, and the strap hooks 44 are made from stainless steel.

Figure 5:
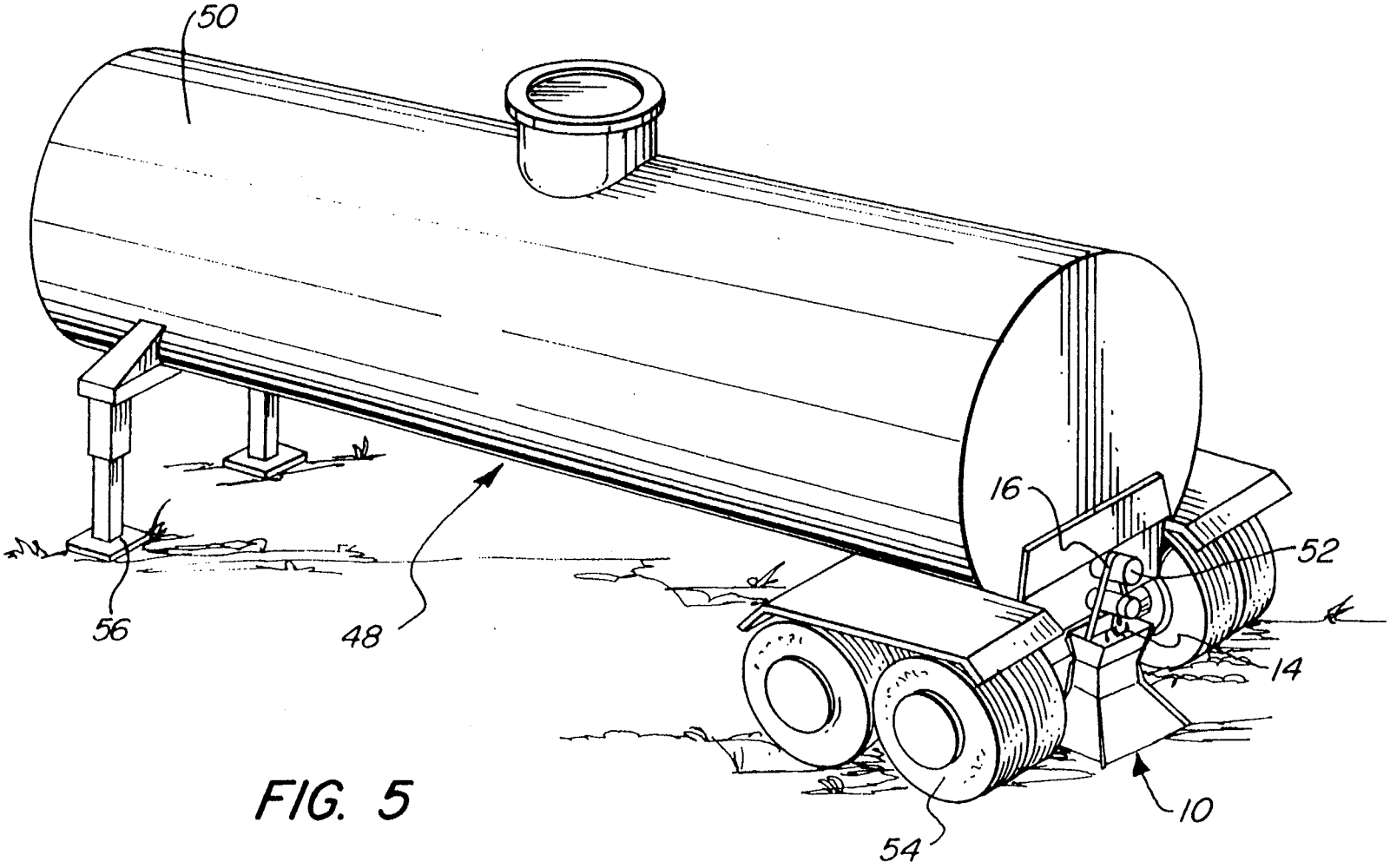
FIG. 5 is a perspective view of the spill containment bag shown suspended by its strap below a leaking fitting at the rear of a tank transport.

Turning now to FIG. 5, there is shown a tank transport, generally designated by the numeral 48 and having a tank 50 with an outlet fitting 52. The tank transport 48 also has wheels 54 and landing gear 56, and the tank 50 sits on a chassis (not shown). The spill containment bag 10 has been suspended from the fitting 52 of tank transport trailer 48 by draping the straps 16 over the fitting 52 and inserting the strap hooks 44 through the eyelets 40 of the containment bag 10. It should be noted that the bag 10 is in an extended position with the bag opening 14 directly beneath the fitting 52. Any liquid leaking from the fitting 52 is collected within the containment bag 10 and will not fall onto the pavement or surrounding area.

After the leak has been stopped, the liquid collected in the containment bag 10 can be pumped into another tanker truck (not shown) or back into the tank 50. Thereinafter, the containment bag 10 can be decontaminated, collapsed and folded into a small package for reuse.

In a similar manner, the containment bag 10 can be installed to contain leaks in the tanks, containers, pipes or valves located within a factory or a materials storage area.

As seen in FIG. 2, the bag member 12 is fabricated from sheet material with sealed seams 38 to provide a leak proof container, with the sealing being effected by means of separate adhesives, or heat or solvent depending upon the material. Optionally, the seams of the bag may be both sealed, and sewn. If the bag is to contain solid spills only, then the seams may be sewn only. These seams add rigidity to the overall structure, allowing it to maintain an extended position.

The sheet material is preferably foldable, durable, and resistant to the materials which may be received therein. Suitable materials for the bag member include synthetic rubber (e.g. butadiene/acrylonitrile copolymer, polychloroprene, polyisoprene) polyurethanes, polypropylene and polyvinyl chloride. The materials provide desired chemical inertness and a capability of withstanding concentrated acids, alkalis, solvents, petrochemicals and other chemical compounds of either a hazardous or non-hazardous nature.

The resin sheeting may be reinforced by glass, carbon, cotton, nylon and other fibers to increase strength. In a preferred embodiment, a laminate of a nylon woven material core with resin outer layers of polyurethane or rubber, provides a fluid impermeable structure which is relatively lighter weight and durable.

In the embodiment of FIGS. 1–5, the bag member 12 is conveniently fabricated from two pieces. The first piece provides the bottom wall 26, any two opposing lower panels 24, two opposing collar panels 34 that connect to the upper margins of the opposing lower panels 24, and the two opposing panels 36 that connect to the upper margins of the opposing collar panels 34. The other piece provides another layer of the bottom wall 26 and the other panels 24, 34 and 36. In this manner, the bag member 12 is provided with a double layered bottom wall 26 for extra strength.

Figure 6:
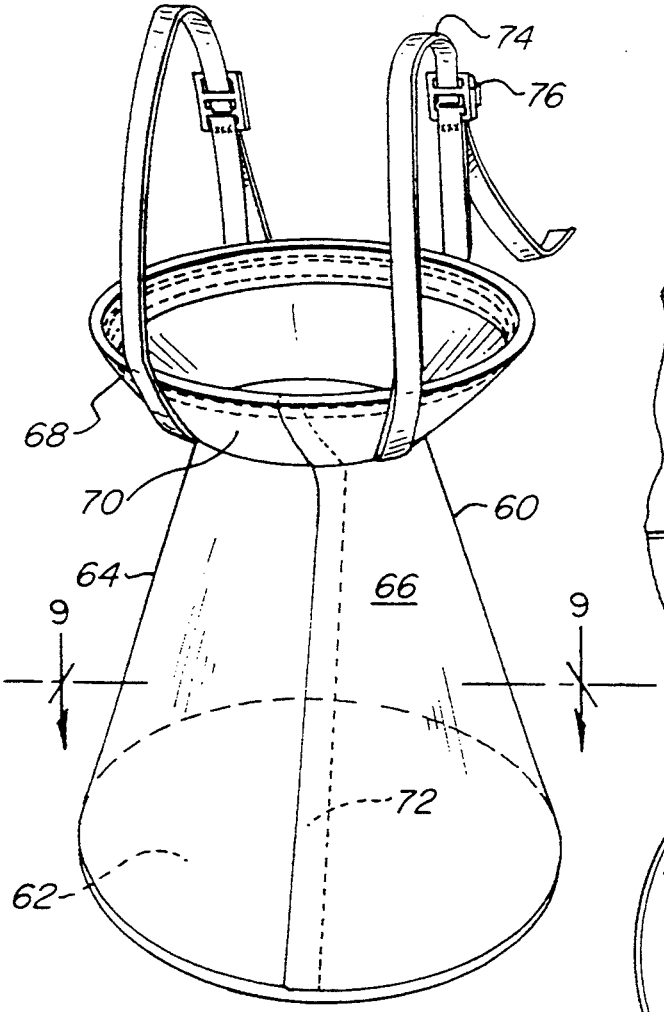
FIG. 6 is a perspective view of another containment bag embodying the present invention.
Figure 8:
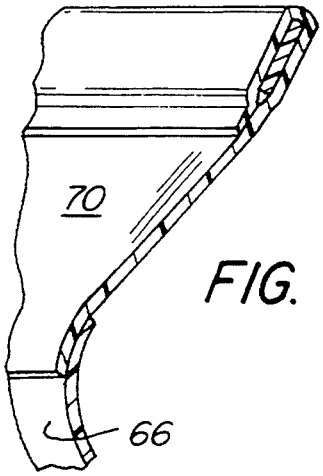
FIG. 8 is a fragmentary enlarged sectional view of the upper section thereof along the line 8—8 of FIG. 7.
Figure 7:
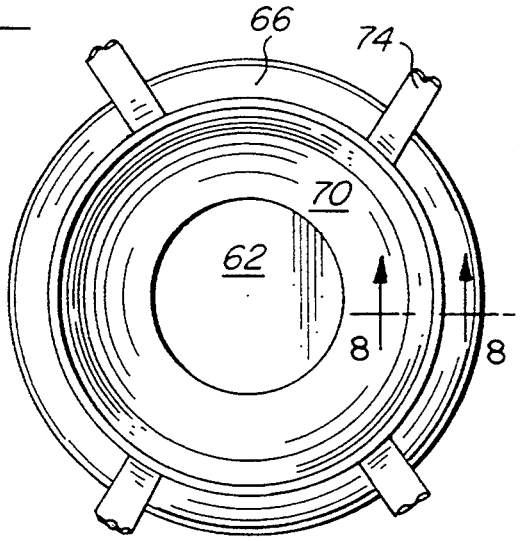
FIG. 7 is a top plan view thereof.
Figure 9:
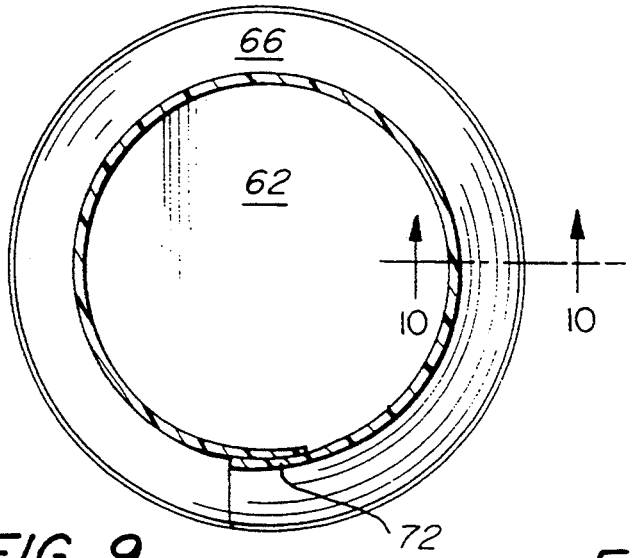
FIG. 9 is a sectional view of the containment bag along the line 9—9 of FIG. 6.
Figure 10:
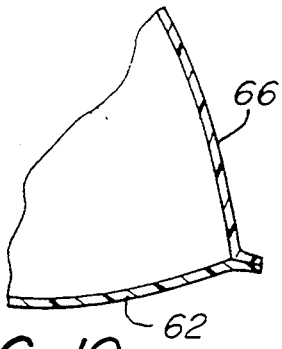
FIG. 10 is a enlarged fragmentary sectional view along the line 10—10 of FIG. 9.

Turning now to FIGS. 6–12, therein illustrated is a preferred construction in which the bag member 60 has a circular cross section and a circular bottom wall 62. The lower section 64 is of frustroconical configuration with a lower sidewall 66, and the upper section 68 is of shorter, inverted frustroconical configuration with an upper sidewall 70. The sidewalls 66, 70 overlap and are sealed as seen in FIG. 8, and the bottom wall 62 is sealed to the lower end of the lower sidewall 66. As seen in FIG. 6, the sidewalls 66, 70 have overlapping portions which provide a sealed seam 72.

In the embodiment of FIGS. 6–10, the straps 74 are secured to the upper section 68 and have buckles 76 to allow adjustment of the length thereof.

Figure 11:
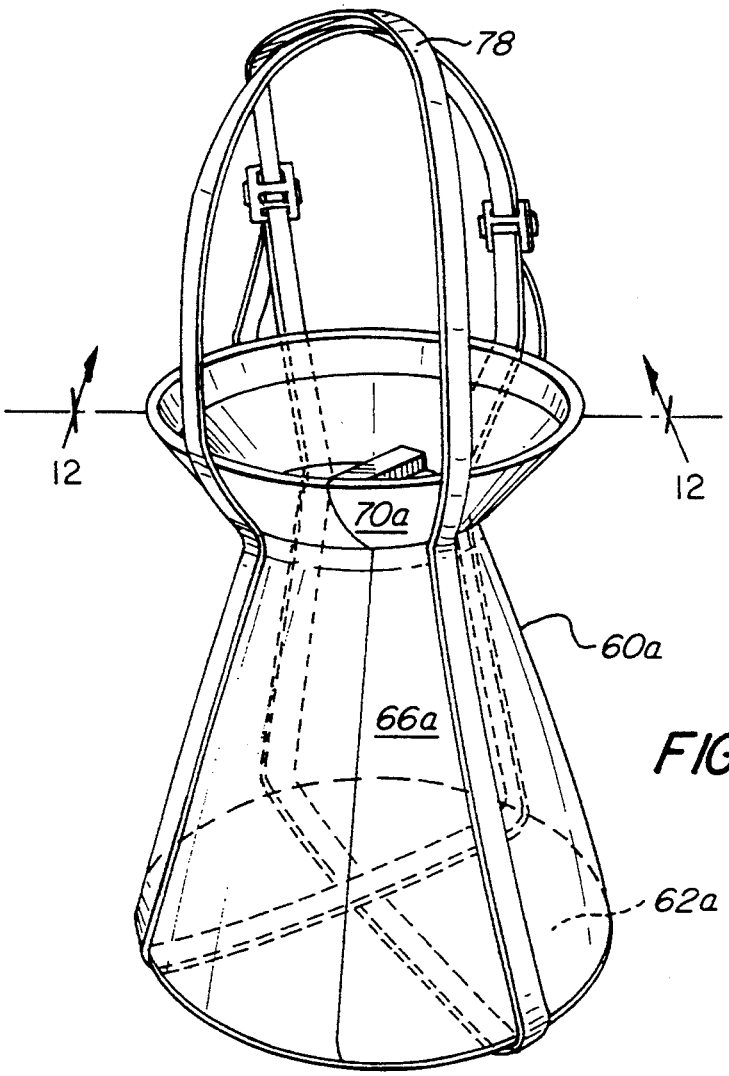
FIG. 11 is a perspective view of still another embodiment of the containment bag of the present invention.
Figure 12:
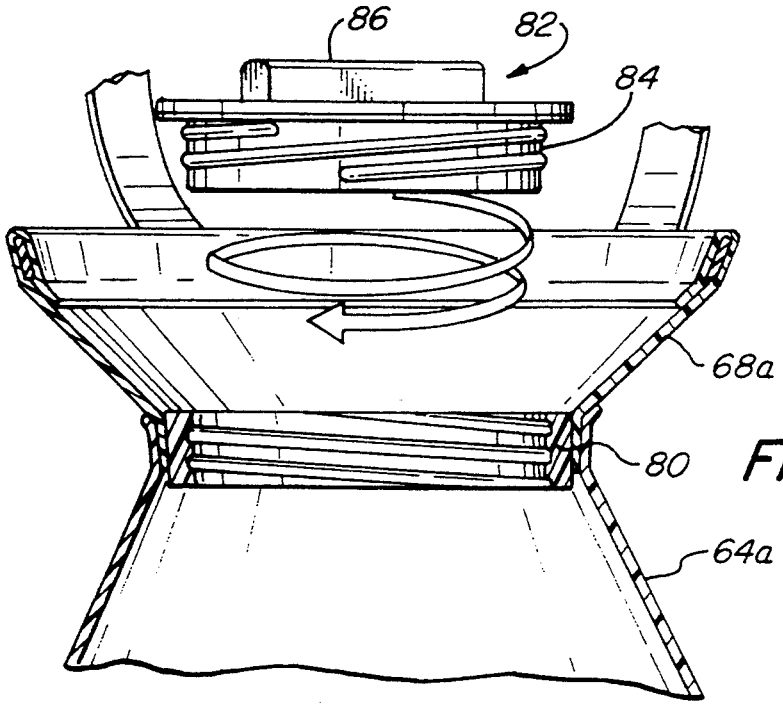
FIG. 12 is a enlarged fragmentary sectional view thereof along the line 12—12 and showing the closure disassembled therefrom.

In the embodiment of FIGS. 11 and 12, the straps 78 extend about the bottom wall **62*a* and along the sidewalls 66*a*, 70*a*, and are bonded to the bag member 60*a*. In this embodiment there is an internally threaded collar 80 at the juncture of the sections 64*a*, 68*a*, and a plug generally designated by the numeral 82 has an externally threaded body 84 and a projecting grip 86. This facilitates manipulation and rotation as indicated by the arrow in FIG. 12 to threadably engage the plug 82 in the collar 80**. After collecting the leaking material, the bag member may be sealed so that it may be transported safely.

The spill containment bags of the present invention may be carried in a folded condition within a compartment of a vehicle so as to be readily accessible in an emergency situation to contain a spill of any solid or liquid. The bags may be carried in the vehicles of state, local and federal authorities or stored in strategic locations such as toll booths, state garages and weighing stations to enable rapid response to emergency spills and to minimize the environmental impact. In storage areas where the tanks are stationary, such as industrial plants, tank farms and the like, the containment bags may be stored in suitable compartments in the vicinity.

It should be apparent to those skilled in the art that the containment bag 10 can be formed in a variety of sizes and shapes. The cross section may be other than rectangular or circular if so desired.

The bags may be color coded or otherwise labelled to indicate the types of material which may safely be contained. Additionally, each bag may be labelled with an expiration date indicating the date on which the bag must be replaced because age and exposure to fumes of materials being transported may be deterious to the fabric. Finally, gloves and other personnel protective equipment may be provided with the bag as an emergency kit.

Thus, it can be seen from the foregoing specification and attached drawings that the spill containment bag provides an effective, stable and collapsible means for containing a leak of hazardous or non-hazardous materials. The bag is readily and quickly useable to minimize any environmental impact and may be readily and relatively economically fabricated.

Having thus described the invention, what is claimed is:

1. In a method for containing a spill from a container having a leak, the steps comprising:

(a) providing a spill containment bag including a flexible bag member defining an enclosure having a lower section with a bottom wall and a sidewall extending upwardly and inwardly from the periphery of said bottom wall to a reduced cross section at its upper end intermediate the height of said bag member, and said bag member also having an upper section with a sidewall extending upwardly from the periphery of said sidewall of said lower section , said sidewall having at least its upper portion flaring upwardly and outwardly to provide a funnel shaped opening of enlarged cross section at the upper end of said bag, and means for securing said upper section of said bag to a leaking container;

(b) engaging said securing means of said spill containment bag to a portion of a leaking container;

(c) orienting said containment bag and adjusting said securing means so that said opening in said bag is disposed below and adjacent the point of the leak; and (d) allowing the spill from the point of the leak from the container to flow through said opening and to collect in said enclosure.

2. The method of containing a spill in accordance with claim 1 wherein said step of providing said bag includes providing a collar in said bag member at said juncture of said lower and upper sections and a closure engageable in said collar to seal said lower section, and wherein there is included the further step of engaging a closure with said collar to seal said lower section.

3. The method of containing a spill in accordance with claim 1 wherein said securing means includes at least a multiplicity of adjustable straps engaged with said bag member and extending thereabove, wherein there is included the further step adjusting the length of said straps above said bag member.

4. A spill containment bag for use with a container having a leak, comprising:

(a) a flexible bag member defining an enclosure, said bag member having a lower section with a bottom wall and a sidewall extending upwardly and inwardly from the periphery of said bottom wall to a reduced cross section at its upper end intermediate the height of said bag member, and said bag member also having an upper section with a sidewall extending upwardly from the periphery of said sidewall of said lower section, said sidewall of said upper section having at least its upper portion flaring upwardly and outwardly to provide a funnel shaped opening of enlarged cross section at the upper end of said bag member; and (b) adjustable means for securing the upper section of said bag member to a leaking container so as to position said opening at the upper end thereof beneath the point of leakage.

5. The spill containment bag in accordance with claim 4 wherein said flexible bag member has a circular cross section, with a frustroconical lower section and a shorter inverted frustroconical upper section.

6. The spill containment bag in accordance with claim 4 wherein said flexible bag member has a rectangular cross section, and said sidewall of said lower section and said upper portion of said sidewall of said upper section have panels which are generally trapezoidal in configuration.

7. The spill containment bag in accordance with claim 6 wherein the sidewall of said upper section has a generally rectangular lower portion providing a collar above the sidewall of said lower section.

8. The spill containment bag in accordance with claim 4 wherein said securing means includes a multiplicity of straps engaged with said bag member and extending thereabove.

9. The spill containment bag in accordance with claim 8 wherein said multiplicity of straps extend about the bottom wall and along the side walls of said lower and upper sections.

10. The spill containment bag in accordance with claim 8 wherein said multiplicity of straps include means for adjusting the length thereof above said bag member.

11. The spill containment bag in accordance with claim 4 wherein said enclosure is fabricated from a liquid impervious material for use with a liquid leak.

12. The spill containment bag in accordance with claim 4 wherein there are included a collar in said bag member at the juncture of said lower and upper sections and a closure engageable in said collar to seal said enclosure of said lower section.

13. The spill containment bag in accordance with claim 12 wherein said collar is internally threaded and said closure is a circumferentially threaded element.

* * * * *